US007721923B2

(12) United States Patent
Holt

(10) Patent No.: US 7,721,923 B2
(45) Date of Patent: May 25, 2010

(54) APPARATUS AND METHOD FOR TEXTILE MAINTENANCE

(76) Inventor: Joyce Y. Holt, 3719 Logan Ave. N., Minneapolis, MN (US) 55412

( * ) Notice: Subject to any disclaimer, the term of this patent is extended or adjusted under 35 U.S.C. 154(b) by 744 days.

(21) Appl. No.: 11/125,293

(22) Filed: May 9, 2005

(65) Prior Publication Data

US 2006/0249548 A1 Nov. 9, 2006

(51) Int. Cl.
*A41H 43/00* (2006.01)

(52) U.S. Cl. ..... 223/1; 223/66

(58) Field of Classification Search ..... 223/1, 223/52, 57, 66, 71, 120, DIG. 2; 38/102.91; 112/103

See application file for complete search history.

(56) References Cited

U.S. PATENT DOCUMENTS

| | | | | | |
|---|---|---|---|---|---|
| 836,438 | A * | 11/1906 | Coey | 38/102.91 |
| 2,959,825 | A * | 11/1960 | Gould | 19/157 |
| 3,425,143 | A * | 2/1969 | Feld et al. | 38/102.9 |
| 3,452,959 | A * | 7/1969 | Sadao Ishikawa | 248/488 |
| 4,027,892 | A * | 6/1977 | Parks | 410/3 |
| 4,062,067 | A * | 12/1977 | Franzen | 2/410 |
| 4,798,292 | A * | 1/1989 | Hauze | 206/439 |
| 5,673,827 | A * | 10/1997 | Lamberti | 223/120 |
| 5,878,788 | A * | 3/1999 | Gurry | 140/92.1 |
| 5,934,210 | A * | 8/1999 | Lucchese | 112/103 |
| 6,067,737 | A * | 5/2000 | Guenther | 38/102.2 |
| 6,131,778 | A * | 10/2000 | Etzion | 223/46 |
| 6,322,740 | B1 * | 11/2001 | Hanson et al. | 264/275 |
| 6,560,894 | B2 * | 5/2003 | Leber | 34/280 |
| 6,769,538 | B2 * | 8/2004 | Oswald | 206/77.1 |
| 6,890,138 | B1 * | 5/2005 | Myrick | 410/94 |

* cited by examiner

*Primary Examiner*—Shaun R Hurley
*Assistant Examiner*—Andrew W Sutton
(74) *Attorney, Agent, or Firm*—Dorsey & Whitney LLP; Brett A. Klein

(57) ABSTRACT

An apparatus for textile maintenance comprises a base component containing a plurality of holes and at least one coupling member. Multiple base components may be interlocked by means of the coupling member(s). Retention members snugly fit into the plurality of holes of a base component. The retention members support one or more textile pieces adjacent to a base component. Additionally, the retention members may be used to stack a base component onto another base component. A user may then use a base component or any combination of base components to perform textile maintenance, such as drying or starching.

20 Claims, 6 Drawing Sheets

APPARATUS AND METHOD FOR TEXTILE MAINTENANCE

FIELD OF THE INVENTION

The present invention relates to an apparatus for textile maintenance and a method for using the same.

BACKGROUND

In-home maintenance of various textiles, including hand-crafted textiles such as doilies and the like, has not changed for many years. Typically, a textile owner is forced to place the article to be cleaned or maintained on any available flat surface for cleaning, treatment, or maintenance. For example, a hand-crafted article might be placed on a floor or table in the user's home and then treated as necessary. Such make-shift methods make it difficult to stabilize the article or keep the article from becoming soiled with dirt or dust that has collected on the surface being used.

There is a need in the art, therefore, for a new apparatus and method for textile maintenance.

BRIEF SUMMARY OF THE INVENTION

In one embodiment, the present invention is an apparatus for textile maintenance comprising at least one base component having a plurality of holes configured to receive a retention member and at least one coupling member on an outer portion of the base component configured to be coupleable with a coupling member of another base component.

The present invention, in accordance with another embodiment, is a method for textile maintenance including providing a first apparatus for textile maintenance, positioning at least one textile piece adjacent to at least one base component and securing the textile piece adjacent the base component by inserting at least one retention member through the textile piece into any one of the plurality of holes of the base component.

In an alternative embodiment, a second apparatus for textile maintenance is positioned parallel the first apparatus by inserting a first end of at least one retention member into one of the first plurality of holes of a base component of the first apparatus and inserting a second end of the retention member into one of a second plurality of holes of a base component of the second apparatus.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

The present invention is a method and apparatus for textile maintenance having at least one coupleable base component and a plurality of retention members that each fit snugly into any of a plurality of holes contained on the base component. The invention allows users to perform textile maintenance, such as drying or starching, on one or more textile pieces by supporting one or more textile pieces with the retention members adjacent the base component. Additionally, the retention members may be used to stack a base component onto another base component or combination of base components.

Figure 1:
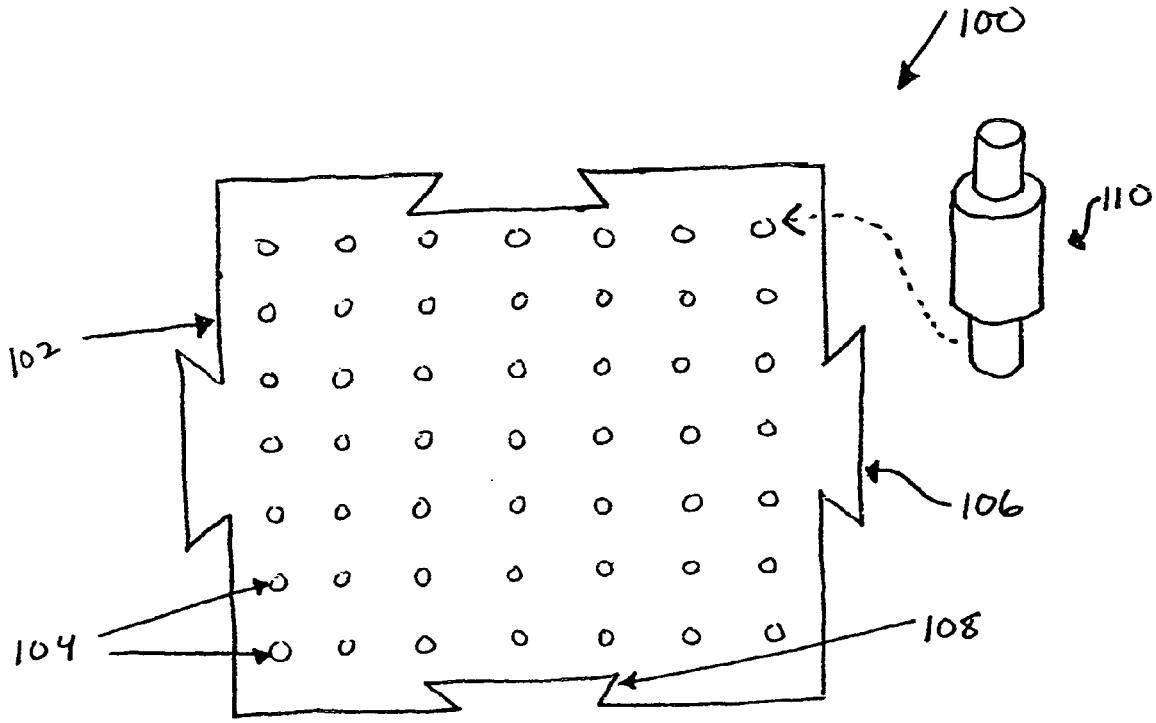
FIG. 1 is a top view of a single base component apparatus and perspective view of a retention member.

FIG. 1 shows one embodiment of the apparatus 100 of the present invention, in which the base component 102 contains a plurality of holes 104 and has four interlocking coupling members 106 and 108, one on each side of the base 102. Two of the coupling members 106 are male while the other two coupling members 108 are female. FIG. 1 further illustrates one embodiment of a retention member 110 of the present invention. The retention member 110 fits snugly into any of the plurality of holes 104 contained on the base component 102. The square shape of the base component 102 shown in the figure is exemplary and does not limit the invention in any way. Other shapes, such as an octagon or trapezoid, may comprise their own advantages.

Figure 2:
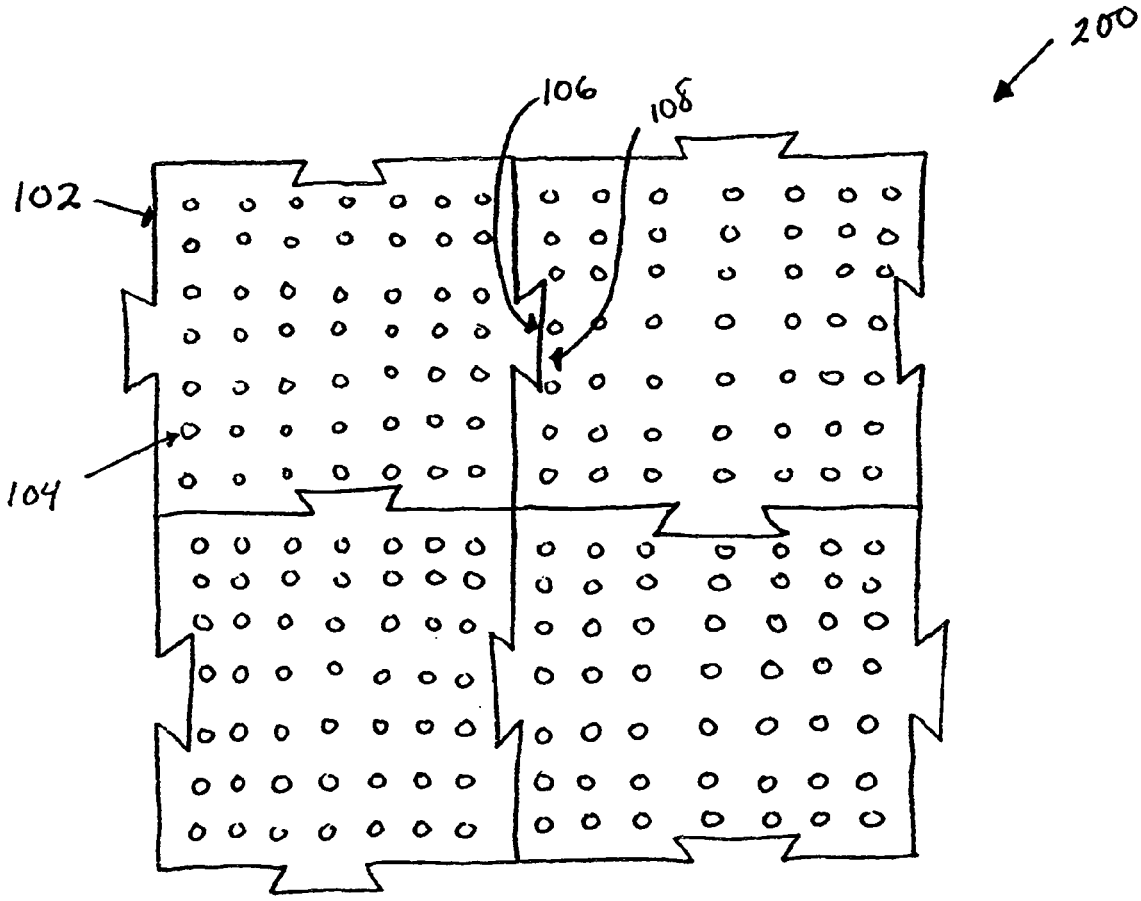
FIG. 2 is a top view of a multi-base component apparatus.

The coupling members 106 and 108 allow for the ability to connect more than one base component 102 together as shown in FIG. 2. In this particular embodiment, certain male coupling members 106 couple with a female coupling member 108, thus interlocking four base components 102. Coupling members 106 and 108 are exemplary and not intended to be limiting. According to an alternative embodiment, each side of the base 102 has more than one coupling member 106 or 108. In a further alternative embodiment, any known coupling component can be used, such as snap-fit components, threaded coupling components or any other known components for attachment.

The resulting multi-base apparatus 200 can be used for maintenance of larger textiles. The multi-base apparatus 200 may have two coupled base components 102. Alternatively, the multi-base apparatus 200 can have as many coupled base components 102 as needed in relation to the size of the textile piece.

Figure 3:
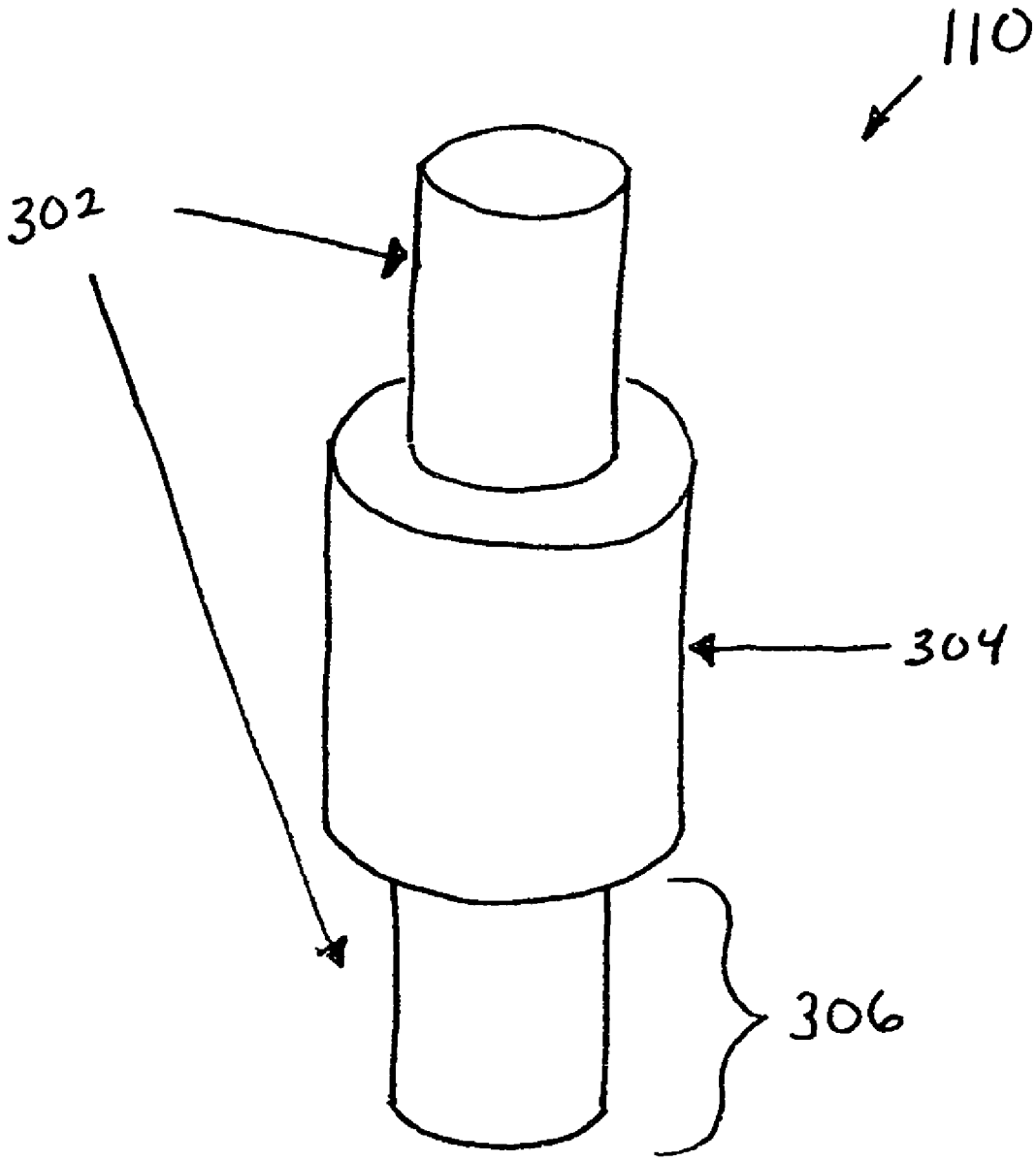
FIG. 3 is a perspective view of a retention member.

FIG. 3 shows one embodiment of the retention member 110 of the present invention. The retention member 110 has two ends 302 which are manufactured to snugly fit into any of the holes 104 of any base 102. Between the two ends 302, the retention member 110 has an enlarged body 304 manufactured to have an external diameter that is greater than an internal diameter of the holes 104. The shape of the retention member 110 is not limited to cylindrical nor is it necessary for there to be an enlarged body 304.

Figure 4:
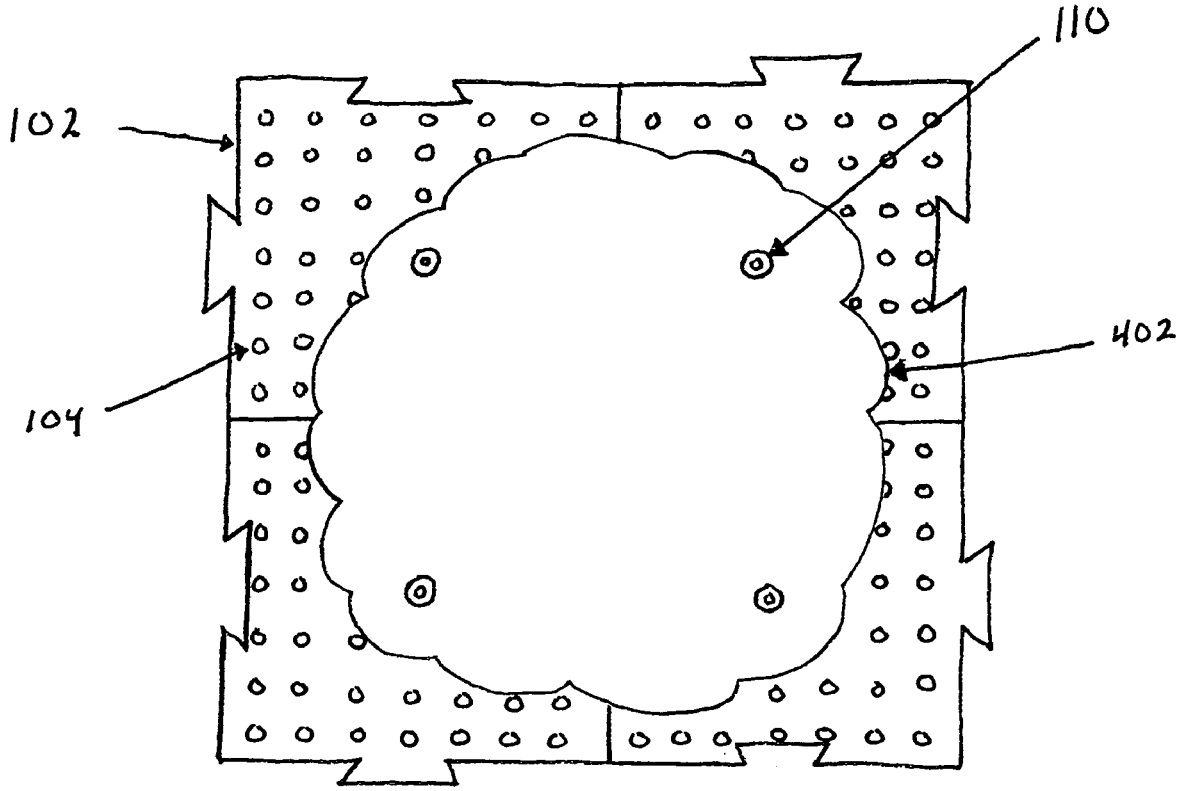
FIG. 4 is top view of a textile piece supported by retention members on a multi-base component apparatus.

The retention member 110 of the present invention serves as a peg to support textiles on the apparatus 100. As shown in FIG. 4, a textile piece 402 is positioned in contact with the appropriate number of base components 102. In another embodiment, further textile pieces may be positioned over the first textile piece 402 adjacent the base components 102. Then, one of the ends 302 of the retention member 110 is inserted through the textile piece 402 and into any of the holes 104 of a base component 102. The enlarged body 304 of the retention member 110 holds the textile piece firmly to the base 102. The textile piece 402 in FIG. 4 is supported on the multi-base apparatus 200 with four retention members 110.

Any number of retention members 110 may be used. Each base 102 or multi-base apparatus 200 may support one textile piece 402. Alternatively, each base 102 or multi-base apparatus 200 can support any number of textile pieces 402 as needed. In the latter case, the length 306 of the ends 302 of the retention members 110 will necessarily be increased or decreased to adapt for the number of textile pieces 402 being supported.

Figure 5:
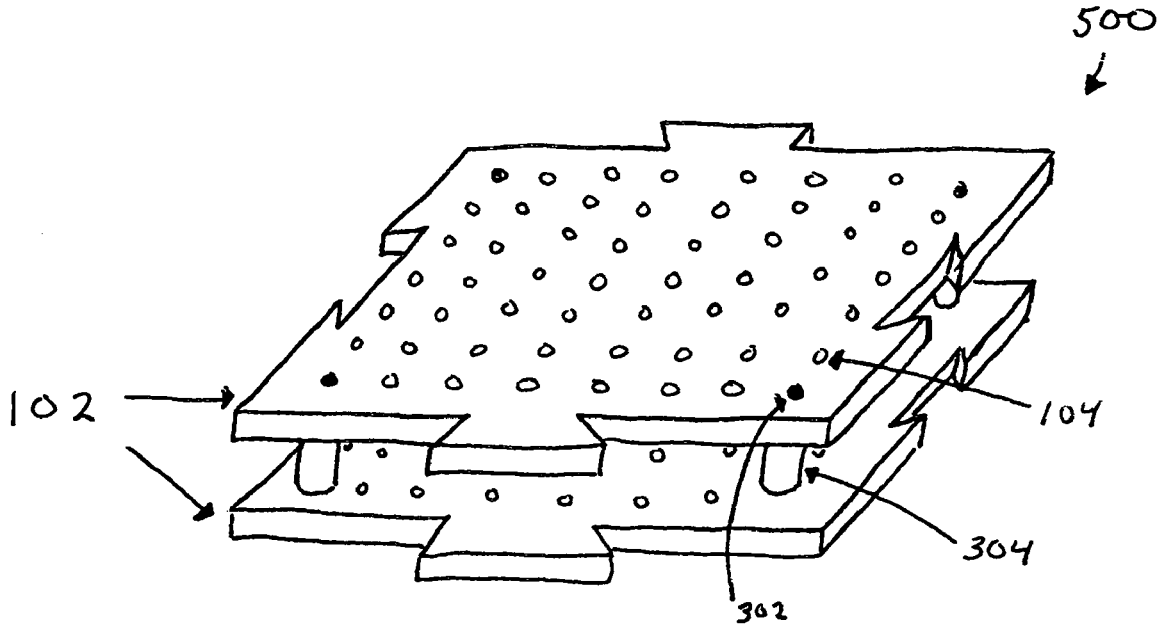
FIG. 5 is a perspective view of a single base component stacked on top of a second single base component.

According to one aspect of the invention, each retention member 110 also serves the dual purpose of supporting a second base component 102. As shown in FIG. 5, a first end 302 of a retention member 304 is inserted into one of the holes of a first base component 102. A second base component 102 is then stacked on the first base component 102 by inserting a second end 302 of the retention member 110 into one of the holes of the second base component 102. In FIG. 5, the upper base component 102, is supported by four retention members 110.

The apparatus 500 shown in FIG. 5, consisting of two single base components, can easily be expanded to apply to multi-base apparatuses 200 as shown in FIG. 2. Furthermore, the resulting apparatus 500 is not limited to two levels as shown in FIG. 5. The resulting apparatus 500 can have as many levels of base components 102 as needed. Each level can be used for supporting textiles as previously described.

Figure 6:
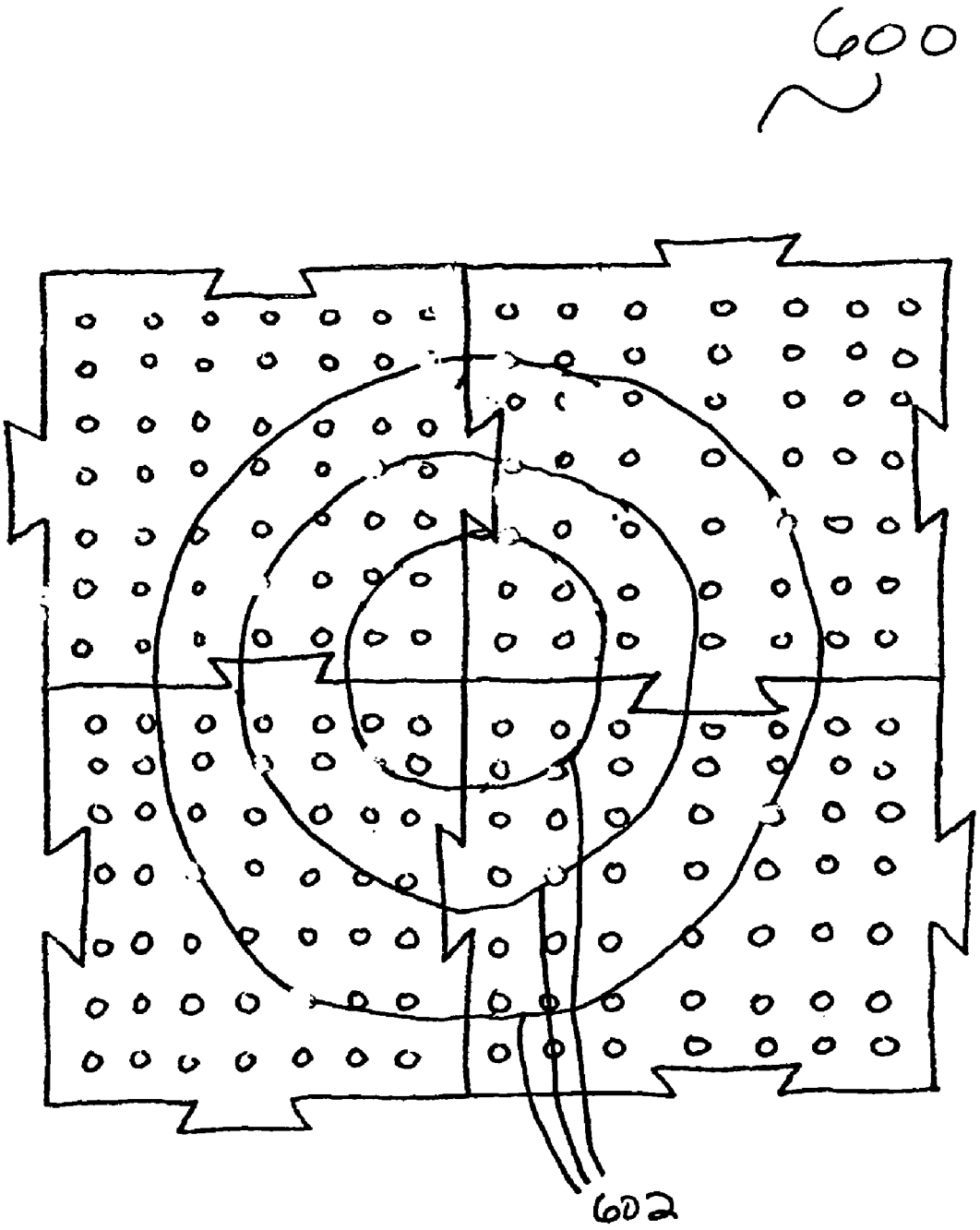
FIG. 6 is a top view of an apparatus having markings on its face, according to certain embodiments.

FIG. 6 depicts a textile maintenance apparatus 600, according to an alternative embodiment of the present invention. The apparatus 600 has markings 602 on the face of the apparatus 600. According to one embodiment, the markings 602 provide the user guidance for positioning the textile to be treated on the apparatus 600. In one aspect of the invention, the markings 602 include numbers to indicate sizes. For example, each marking 602 might have a number associated with the marking 602 to indicate the size of the circular textile article and to guide the user in positioning the article on the apparatus 600. For example, one of the markings 602 might have "9 inches" or "9"" associated with it, indicating that a 9-inch circular article, which could be a doily, for example, can be positioned within the marking 602. Alternatively, the markings 602 are square to assist with positioning square articles. In a further alternative, any markings that might assist with positioning of the article or use of the invention can be placed on the apparatus 600.

In use, the present invention can be used for maintenance of textile pieces such as crocheted pieces, embroidered pieces, linen, fabric, cloth, or other similar work. After washing, a textile piece can be dried using an apparatus of the present invention by supporting the textile piece on one or more base components 102 with one or more retention members 110. Alternatively, the textile piece can be sprayed with a chemical, such as starch, while being supported adjacent to a base component 102 with one or more retention members 110. Furthermore, one skilled in the art could see that the present invention is useful for textile maintenance other than drying or spraying with chemicals.

Although the present invention has been described with reference to preferred embodiments, persons skilled in the art will recognize that changes may be made in form and detail without departing from the spirit and scope of the invention.

I claim:

1. An apparatus for textile maintenance comprising at least two base components, each base component comprising:

(a) a plurality of holes, each of the holes configured to receive a retention member; and (b) at least one coupling member associated with an outer portion of each base component, the coupling member configured to be removably coupleable with a coupling member of another base component oriented substantially within the same plane as the coupling member's respective base component, the apparatus further comprising at least one retention member configured to:

be removably inserted into any of the plurality of holes in a first of the at least two base components while also being removably inserted into any of the plurality of holes in a second of the at least two base components; and support the second base component parallel to and in spaced stacked relationship with the first base component.

2. The apparatus of claim 1, wherein each of the plurality of holes is configured to receive the at least one retention member on either side of the base component.

3. The apparatus of claim 2 wherein the retention member is a peg.

4. The apparatus of claim 2 wherein the at least one retention member comprises an insertion member at each end of the retention member, each of the insertion members configured to fit into any of the plurality of holes.

5. The apparatus of claim 4 wherein the at least one retention member comprises an enlarged body between the insertion members wherein said enlarged body is configured to have an external diameter that is greater than an internal diameter of each of the plurality of holes.

6. The apparatus of claim 1, wherein the at least two base components each comprise at least three sides and the at least one coupling member is associated with one of the at least three sides.

7. The apparatus of claim 6, wherein the at least three sides comprises four sides and the at least one coupling member comprises at least two coupling members.

8. The apparatus of claim 7, wherein the at least two coupling members comprise a first male coupling projection and a first female coupling recess, the first male coupling projection being associated with a first of the four sides and the first female coupling recess being associated with a second of the four sides.

9. The apparatus of claim 8, wherein the at least two coupling members comprise four coupling members comprising a second male coupling projection and a second female coupling recess, the second male coupling projection being associated with a third of the four sides and the second female coupling recess being associated with a fourth of the four sides.

10. The apparatus of claim 7, wherein each of the four sides comprises at least one coupling member.

11. A method for textile maintenance comprising:

(a) selecting a first base component from a group of base components, each base component of the group comprising:

(i) a plurality of holes in a surface, each of the holes configured to receive a retention member; and (ii) a coupling member associated with an outer portion of the base component, the coupling member configured to be coupleable with a coupling member of another base component;

(b) selecting a second base component from the group;

(c) coupling the first base component with the second base component, the coupling comprising:

(i) positioning the first base component parallel to, substantially adjacent to, and slightly out of plane from the second base component;

(ii) aligning the coupling member of the first base component with the coupling member of the second base component; and (iii) pressing the first base component into the plane of the second base component thereby engaging the coupling member of the first base component with the coupling member of the second base component;

(d) positioning at least one textile piece on the surface of the first, the second, or both base components; and (e) inserting a first end of a retention member through the textile piece into any one of the plurality of holes of the first or second base component, thereby securing the at least one textile piece to the surface of the first and second base component.

12. The method according to claim 11 wherein the at least one textile piece is a crocheted piece, an embroidered piece, a linen, a fabric, a cloth, or other similar work.

13. The method according to claim 12 further comprising drying the at least one textile piece.

14. The method according to claim 12 further comprising spraying starch on the at least one textile piece.

15. The method according to claim 11 wherein each of the plurality of holes is configured to receive a retention member on either side of the base component.

16. The method according to claim 15 further comprising:

(a) selecting a third base component from the group; and (b) inserting a second end of the retention member into any of the plurality of holes of the third base component, thereby positioning the third base component parallel to and in spaced stacked relationship to the first and second base component.

17. The method of claim 13, further comprising removing the at least one textile piece.

18. The method of claim 14, further comprising drying the at least one textile piece.

19. The method of claim 16, further comprising:

(a) selecting a fourth base component from the group;

(b) inserting a first end of another retention member into one of the plurality of holes of the first or second base component;

(c) inserting a second end of the another retention member into any of the plurality of holes of the fourth base component, thereby positioning the fourth base component parallel to and in spaced stacked relationship to the first and second base component; and (d) coupling the third base component with the fourth base component.

20. The method of claim 16, further comprising positioning at least one textile piece on the surface of the third base component.

* * * * *